US005467572A

United States Patent [19]

Wile et al.

[11] Patent Number: 5,467,572

[45] Date of Patent: Nov. 21, 1995

[54] BAGGING SYSTEM

[75] Inventors: Richard M. Wile, Medfield, Mass.; Lawrence Cole, Warwick, R.I.

[73] Assignee: EPI Packaging Technologies, Inc., North Dighton, Mass.

[21] Appl. No.: 861,535

[22] Filed: Apr. 1, 1992

[51] Int. Cl.[6] ..... B65B 43/26; B65D 85/62

[52] U.S. Cl. ..... 53/384.1; 53/390; 206/554

[58] Field of Search ..... 206/554; 186/66; 53/384.1, 390, 571, 572

[56] References Cited

U.S. PATENT DOCUMENTS

| | | | |
|---|---|---|---|
| 3,329,260 | 7/1967 | Medleycott | 53/572 X |
| 3,587,845 | 6/1971 | Wing | 206/554 |
| 4,062,170 | 12/1977 | Orem . | |
| 4,480,750 | 11/1984 | Dancy . | |
| 4,676,378 | 6/1987 | Baxley et al. . | |
| 4,785,938 | 11/1988 | Benoit et al. | 206/554 |
| 4,849,090 | 7/1989 | Case et al. | 206/554 X |
| 4,869,045 | 9/1989 | d'Estaintot | 53/390 X |
| 4,989,732 | 2/1991 | Smith | 206/554 |
| 5,020,750 | 6/1991 | Vrooman et al. | 53/390 X |

*Primary Examiner*—Linda Johnson
*Attorney, Agent, or Firm*—Henry D. Pahl, Jr.

[57] ABSTRACT

The bagging system disclosed herein utilizes T-shirt type bags which are mounted on the projecting arms of a rack by means of holes through the handle portions of the bags. Between the handles a mounting tab extends upward from the front and back panels of the bag. Near its upper end, each tab includes an aperture which can be placed over a mounting hook on the rack and, below this aperture, is a transverse slit leaving only easily severed portions on each side thereof. An adhesive bond is provided between the adjacent tabs in successive sacks. This bond is provided on the facing portions of the mounting tabs above the bag mouth and below the respective transverse slit. The bond is strong enough to tear the easily severed portions. Accordingly, removal of one bag from the rack causes the front wall of the next bag to be torn from the respective central tab and that next bag is then opened across the arms while remaining attached to the bag behind.

4 Claims, 1 Drawing Sheet

BAGGING SYSTEM

BACKGROUND OF THE INVENTION

The present invention relates to rack mountable T-shirt type bags and more particularly to a bagging system and bag pack construction which facilitate the opening of the next bag in a pack upon removal of a preceding bag from the rack.

It is well known in the art to construct so-called T-shirt type bags from thermoplastic film by forming a gusseted tube of the film and then heat sealing the tube at the beginning and end of preselected lengths thereof. The preselected lengths are then separated and a shaped cutout is made at one end of each length to form an openable bag mouth with handles at each side of the mouth. In accordance with various designs, T-shirt type bags are mounted on a rack providing spaced parallel horizontal arms which extend through openings in the bag handles. A mounting tab is typically provided extending upwardly from the front and back panels of the bag mouth between the handles to facilitate mounting on the rack. Examples of such general construction types are disclosed for example in U.S. Pat. Nos. 4,062,170; 4,480,750; and 4,676,378.

It has also been proposed to facilitate the opening of successive bags on the rack by providing a spot of adhesive joining the back panel of each bag with the front panel of the successive bag in the pack. This proposal is, for example, disclosed in the Baxley et al. U.S. Pat. No. 4,676,378. The design in the Baxley et al. patent, however, has not been commercially successful since the application of the glue spot, as illustrated, does not fully open the bag along the arms of the rack and the breaking of the glued bond can produce tearing of the bag in a location where stresses produced by carrying merchandise can propagate a tear and cause bag failure.

Among the several objects of the present invention may be noted the provision of a novel merchandise bagging system; the provision of such a system which utilizes T-shirt type bags inexpensively manufactured from thermoplastic film; the provision of such a system in which the removal of one bag from a pack mounted on a supporting rack will cause the opening of a successive bag in the pack to facilitate filling thereof; the provision of such a system which does not cause weakening of the bags which would lead to failure thereof; the provision of such a system which effects a fairly complete opening of the mouth of a bag upon removal a preceding bag; the provision of such a system which does not cause the generation of litter during a merchandising bagging operation; the provision of such a system which allows successive bags to be easily removed from the rack and pack when filling has been completed; the provision of such a system which is highly reliable; the provision of such a system which is of simple and relatively inexpensive construction. Other objects and features will be in part apparent and in part pointed out hereinafter.

SUMMARY OF THE INVENTION

In accordance with one aspect, a merchandising bagging system according to the present invention employs a rack providing a pair of spaced, generally parallel cantilevered arms and, between the arms at one end thereof, a mounting hook. The rack receives a pack of T-shirt type bags having front and back panels providing an openable mouth therebetween with handles at each side of the mouth. A tab extends upwardly from the front and back panels of the bag between the handles and each handle has a mounting aperture for receiving one of the rack arms. Each tab has an opening for receiving the rack mounting hook and, below that opening, a transverse slit is provided leaving only easily severed portions of the tab on each side thereof. Between adjacent tabs on successive bags in the pack, at a point just below the slit and above the mouth of the respective bag, a releasable adhesive bond is provided which links the successive bags. The adhesive bond is sufficiently strong to tear the easily severed portions. Accordingly, removal of one bag from the rack will cause the front wall of the next bag to be torn from the respective central tab and that next bag to be opened across the arms.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
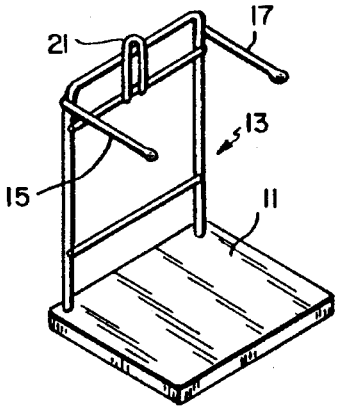
FIG. 1 is a perspective view of a mounting rack employed in the system of the present invention.

Referring now to FIG. 1, the rack illustrated there employs a base panel 11 supporting an upstanding formed-wire frame 13. Extending forwardly from the frame 13 are a pair of spaced, generally parallel, cantilevered arms 15 and 17. A mounting hook 21 is provided on the frame 13 between the support arms 15 and 17. The rack itself is essentially conventional and is adapted to hold a pack of T-shirt type shopping bags.

Figure 2:
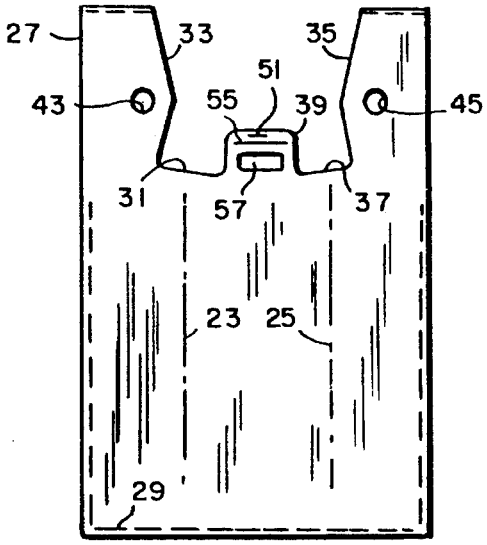
FIG. 2 is a face view of a pack of T-shirt type bags of the type used in the system of the present invention showing the outline of the bag, the location of various slits and apertures, and the placement of an adhesive for linking successive bags.

In accordance with the practice of the present invention, the individual bags which make up a pack have an outline as illustrated in FIG. 2. The bags are manufactured in generally conventional manner from a gusseted tube of thermoplastic film, the gussets in the tube being indicated by reference characters 23 and 25. The tube itself may be formed directly by extrusion or may be formed by side sealing strips cut from a larger extruded tube in conventional manner. Heat seals, as designated by reference characters 27 and 29, are provided at the beginning and end of preselected lengths of the gusseted tube and then the lengths are separated to provide the individual bags. By means of a suitable die, a mouth cut-out is made as indicated by reference character 31. The mouth cut-out 31 leaves handles 33 and 35 on each side of an openable mouth edge 37. A central tab, designated generally by reference character 39, extends upwardly from each of the front and back face panels of the bag above the mouth edge 37 between the handle portions 33 and 35. Cuts are also provided, as indicated by reference characters 43 and 45, so as to provide apertures in each of the handles between the bag mouth and the upper end of the handle. These apertures are adapted to receive the rack support arms 15 and 17 as illustrated in FIG. 3.

Figure 3:
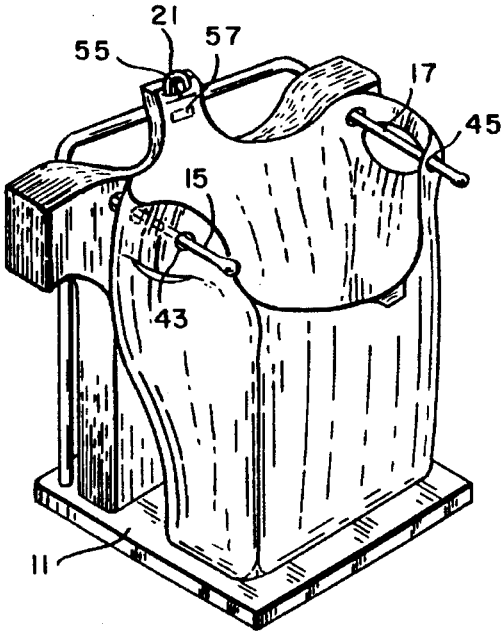
FIG. 3 is a perspective view illustrating the rack of FIG. 1 loaded with the bag pack of the type illustrated in FIG. 2.

Near the upper end of each of the tabs 39 is provided an opening, designated by reference character 51 in FIG. 2, which allows the tabs to be mounted on the rack mounting hook 21, also as illustrated in FIG. 3. A transverse slit is provided as indicated by reference character 55 which extends nearly across the tab 39 and leaves only easily severed portions of the plastic film on either side of the slit.

Between the slit 55 and the level of the mouth 37, is a region where adhesive is applied in accordance with the present invention. This region is indicated generally by reference character 57. As is understood by those skilled in the art, the machinery for cutting and stacking the bag blanks includes a tamper arm which packs down bags in a stack. Glue can be applied in the region indicated by reference character 57 by means of a glue gun mounted on that tamper arm and operated in synchronism with the cutting and stacking operation. The glue is applied to the front face of each bag so as to bond it to the next bag in the stack. As is understood, the bags are typically assembled in packs of 50 or 100 and, by means of a counter, the application of glue can be inhibited on the last bag in a pack. As is explained in greater detail hereinafter, it is important that the glue bond be frangible so as to allow individual bags to be removed from the rack and the rest of the pack but the glue bond must also be strong enough to tear the easily severed portions of the film on either side of the transverse slit 55. This balance in bond strength can be obtained by proper choice of adhesive and bond area.

Rather than using the hot melt adhesives which are typically utilized in the bonding of thermoplastic films, it has been found, in accordance with another aspect of the present invention, that a water based, pressure-sensitive adhesive is highly preferable and can be easily applied in emulsion form. A presently preferred adhesive is the Type 33-4030 Water Based Pressure Sensitive Emulsion sold by the National Starch and Chemical Corporation through its Adhesives Division in Bridgewater, N.J. Being water based, this adhesive is relatively easily handled and does not set up immediately upon application. Rather, the desired bond is developed only after the emulsion dries. For supermarket type bags which are about eleven inches wide and about twenty two inches tall, a region 57 which is about ½ inch by 1½ inches has been found appropriate.

Figure 4:
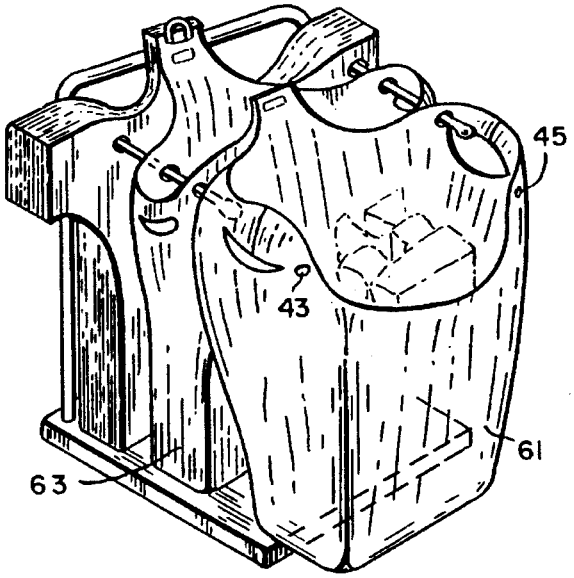
FIG. 4 is a side view illustrating the manner in which successive bags are opened on the rack by the removal of a preceding bag.
Figure 5:
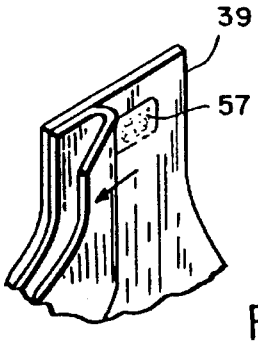
FIG. 5 illustrates a preceding bag being separated from a successive bag.

With reference to FIGS. 4 (and 5), it can be seen that the removal of a filled bag 61 from the rack will draw the front face of the next bag 63 out across the arms by tearing apart the easily severed portions on either side of the slit 55. Since the region of the adhesive bond is near the edge of the mouth, the opening of the next bag will be more complete than is provided by prior designs. Once the filled bag 61 has been drawn clear of the arms, it can be lifted upwardly or moved to the side thereby breaking the adhesive bond between the successive bags as illustrated in FIG. 5. Even if some tearing of the thermoplastic film occurs in the region of the glue placement area 57, it will not significantly weaken the bags since this region is above the mouth 37. Accordingly, rapid loading and dispensing of the loaded bags is greatly facilitated. Further, since the upper or tear-away portions of the tabs 39 are left on the rack mounting hook 21, no litter is generated which could cause slippage and falls.

In view of the foregoing it may be seen that several objects of the present invention are achieved and other advantageous results have been attained.

As various changes could be made in the above constructions without departing from the scope of the invention, it should be understood that all matter contained in the above description or shown in the accompanying drawings shall be interpreted as illustrative and not in a limiting sense.

What is claimed is:

1. A merchandise bagging system comprising:

a rack providing a pair of spaced, generally parallel cantilevered arms and, between said arms at one end thereof, a mounting hook; and mounted on said rack, a pack of T-shirt type bags having front and back panels which are cut out to provide an openable mouth edge with handles at each side of the mouth edge and a protruding tab extending upwards from each panel above the mouth edge between the handles, each handle having a mounting aperture for receiving one of said arms, each tab having an opening for receiving said hook and, below said opening, a transverse slit leaving only easily severed portions of the tab on each side of said slit, and, between the adjacent protruding tabs on successive bags in said pack, below said slit and above said mouth edge of the respective bag, a releasable adhesive bond linking the successive bags, whereby removal of one bag from a rack having arms passing through said handle apertures and a hook engaging said mounting aperture, will cause the front wall of the next bag to be torn from the respective central tab and said next bag to be opened across said arms.

2. The system as set forth in claim 1 wherein said adhesive bond is formed by applying a water based emulsion which, upon drying, forms a pressure sensitive releasable bond.

3. The system as set forth in claim 2 wherein said bond is sufficiently strong to tear said easily severed portions.

4. A merchandise bagging system comprising:

a rack providing a pair of spaced, generally parallel cantilevered arms and, between said arms at one end thereof, a mounting hook; and mounted on said rack, a pack of T-shirt type bags having front and back panels which are cut out to provide an openable mouth edge with handles at each side of the mouth edge and a protruding tab extending upwards from each panel above the mouth edge between the handles, each handle having a mounting aperture for receiving one of said arms, each tab having an opening for receiving said hook and, below said opening, a transverse slit leaving only easily severed portions of the tab on each side of said slit, and, between the adjacent protruding tabs on successive bags in said pack, below said slit and above said mouth edge of the respective bag, a releasable adhesive bond linking the successive bags, the bond being sufficiently strong to tear said easily severed portions whereby removal of one bag from a rack having arms passing through said handle apertures and a hook engaging said mounting aperture, will cause the front wall of the next bag to be torn from the respective central tab and said next bag to be opened across said arms, the adhesive bond between the front wall of said next bag and the said one bag being separated as the said one bag is lifted from the rack.

* * * * *